US005630509A

United States Patent [19]

Su

[11] Patent Number: 5,630,509

[45] Date of Patent: May 20, 1997

[54] ACCORDION-LIKE FILE

[76] Inventor: Ken-Jui Su, No. 102, Lane 52, Fu-Te Road, Shu Wang Tsun, Ta-Li City, Taichung Hsien, Taiwan

[21] Appl. No.: 617,195

[22] Filed: Mar. 18, 1996

[51] Int. Cl.[6] ..... B65D 85/00

[52] U.S. Cl. ..... 206/425; 229/67.1; 229/67.3

[58] Field of Search ..... 206/215, 311, 206/425; 229/67.1, 67.3; 190/900, 901, 902

[56] References Cited

U.S. PATENT DOCUMENTS

| | | | |
|---|---|---|---|
| 1,005,403 | 10/1911 | Zoerb | 206/425 |
| 1,585,237 | 5/1926 | Doughty | 229/67.1 |
| 4,730,727 | 3/1988 | Petroff | 206/425 |
| 5,064,069 | 11/1991 | Su | 206/425 |
| 5,271,505 | 12/1993 | Chang | 206/425 |

*Primary Examiner*—David T. Fidei

*Attorney, Agent, or Firm*—Charles E. Baxley, Esq.

[57] ABSTRACT

An accordion-like file includes a rear panel and a front panel secured to a bottom panel. The front panel has a hook and loop device. A number of envelopes are secured between the rear panel and a plate. The envelopes are expanded when the plate is moved away from the rear panel. The plate has an ear for moving the plate away from the rear panel and has a hook and loop device for engaging with that of the front panel so as to retain the envelopes in the expanded position. The ear is engaged in an opening of the plate.

2 Claims, 4 Drawing Sheets

ACCORDION-LIKE FILE

BACKGROUND OF THE INVENTION

1. Field of the Invention

The present invention relates to a file, and more particularly to an accordion-like file.

2. Description of the Prior Art

The applicant owns a closest prior art disclosed in U.S. Pat. No. 5,064,069 to Su. The prior art discloses an accordion-like file having a folded piece and a block piece that may be folded one relative to the other. However, when paper or documents are received in the envelopes and when the folded piece and the block piece are folded one relative to the other, the paper and the documents may be tilted and may fall due to the inclination of the envelopes.

The present invention has arisen to mitigate and/or obviate the afore-described disadvantages of the conventional accordion-like files.

SUMMARY OF THE INVENTION

The primary objective of the present invention is to provide an accordion-like file in which the envelopes may be easily expanded without tilting the documents.

In accordance with one aspect of the invention, there is provided an accordion-like file comprising a bottom panel, a rear panel secured to the bottom panel at a first folding line and foldable to a perpendicular position relative to the bottom panel, a front panel secured to the bottom panel at a second folding line and foldable to a perpendicular position relative to the bottom panel, the front panel including a first surface having a first engaging means provided thereon and including a second surface having a second engaging means provided thereon, a top panel secured to the rear panel at a third folding line and foldable to a perpendicular position relative to the rear panel, a cover panel secured to the top panel at a fourth folding line and foldable to a perpendicular position relative to the top panel, the cover panel including a third engaging means for engaging with the first engaging means so as to secure the cover panel to the front panel, a plurality of envelopes including a rear portion secured to the rear panel and including a front portion, and a plate secured to the front portion of the envelopes, the envelopes being expanded to an open position when the plate is moved away from the rear panel, the plate including an opening formed therein and including an ear engaged in the opening, the ear including a bottom portion secured to the plate so as to allow the ear to be folded relative to the plate about the bottom portion thereof, the ear including a fourth engaging means secured thereon for engaging with the second engaging means of the front panel when the front panel is disposed horizontally and when the envelopes are expanded so as to maintain the envelopes in the open position.

The ear is engaged in the opening and includes a size smaller than that of the opening so as to define a gap between the ear and the plate for engaging with a finger of a user.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
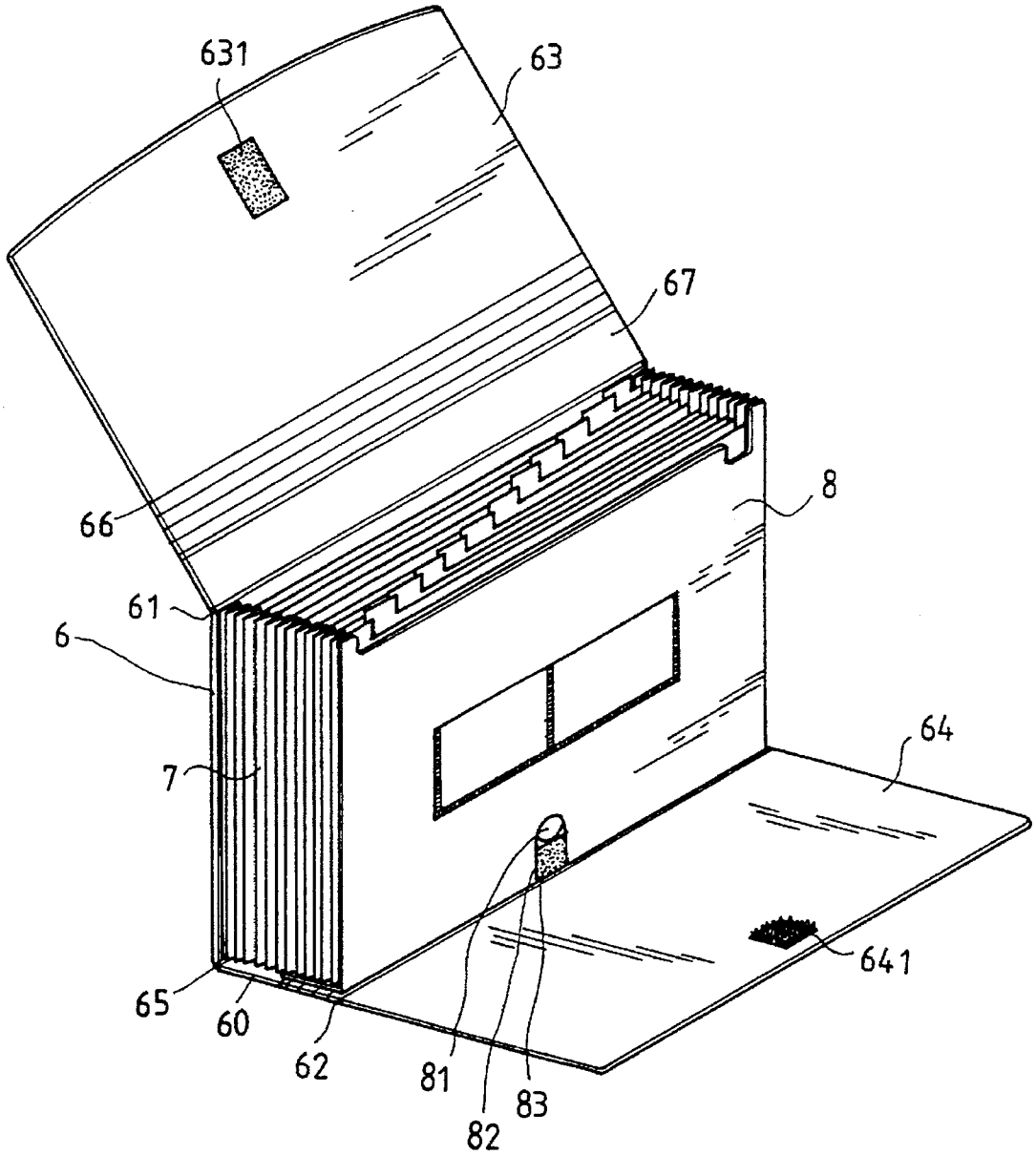
FIG. 1 is a perspective view of an accordion-like file in accordance with the present invention.
Figure 3:
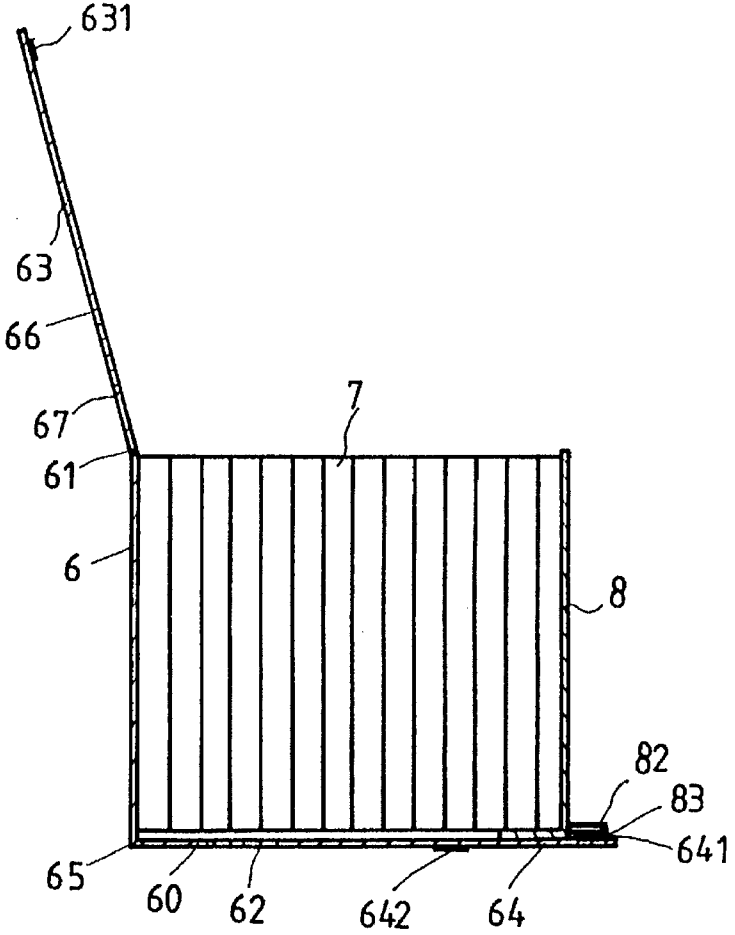
FIGS. 2 and 3 are side views illustrating the operation of the file.
Figure 2:
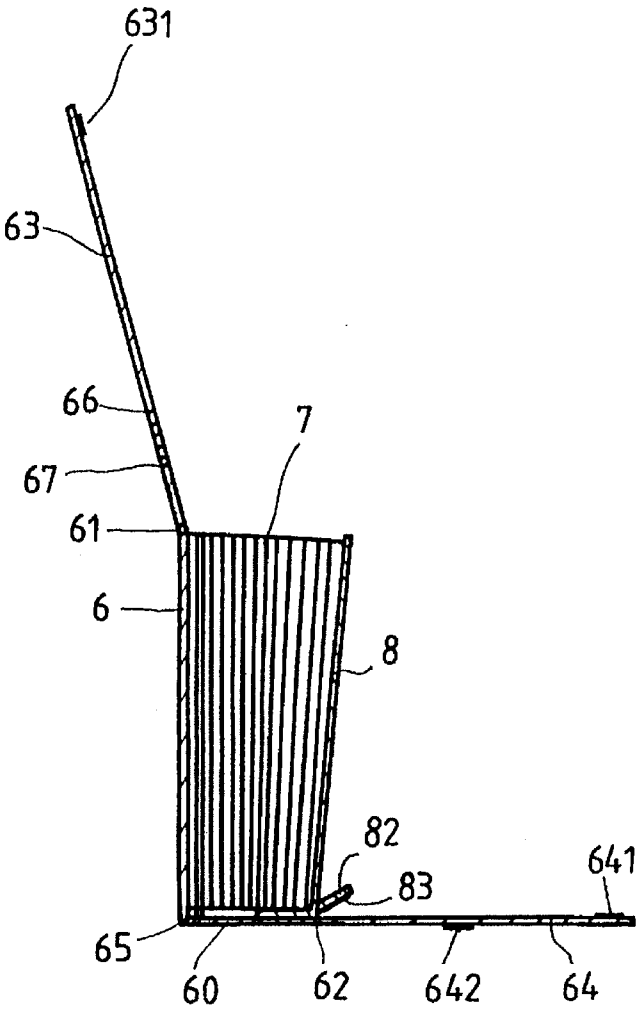

Referring to the drawings, and initially to FIGS. 1 to 3, an accordion-like file in accordance with the present invention comprises a horizontal bottom panel 60, a rear panel 6 secured to the bottom panel 60 at a folding line 65 and foldable to a perpendicular position relative to the bottom panel 60, a front panel 64 secured to the bottom panel 60 at a folding line 62 and foldable to a perpendicular position relative to the bottom panel 60. The front panel 64 includes a hook and loop type engaging member 641 provided on the inner surface and includes another hook and loop type engaging member 642 provided on the outer surface. A top panel 67 is secured to the rear panel 6 at a folding line 61 and foldable to a perpendicular position relative to the rear panel 6. A cover panel 63 is secured to the top panel 67 at a folding line 66 and foldable to a perpendicular position relative to the top panel 67. The cover panel 63 includes a hook and loop type engaging member 631 provided on the inner surface for engaging with the outer engaging member 642 so as to secure the cover panel 63 to the front panel 64.

A number of envelopes 7 have a rear portion secured to the rear panel 6 and have a front portion secured to a plate 8. The envelopes 7 are expandable such that the plate 8 is movable toward or away from the rear panel 6. The envelopes 7 are wide opened for receiving paper and documents therein when the plate 8 is moved away from the rear panel 6.

Figure 6:
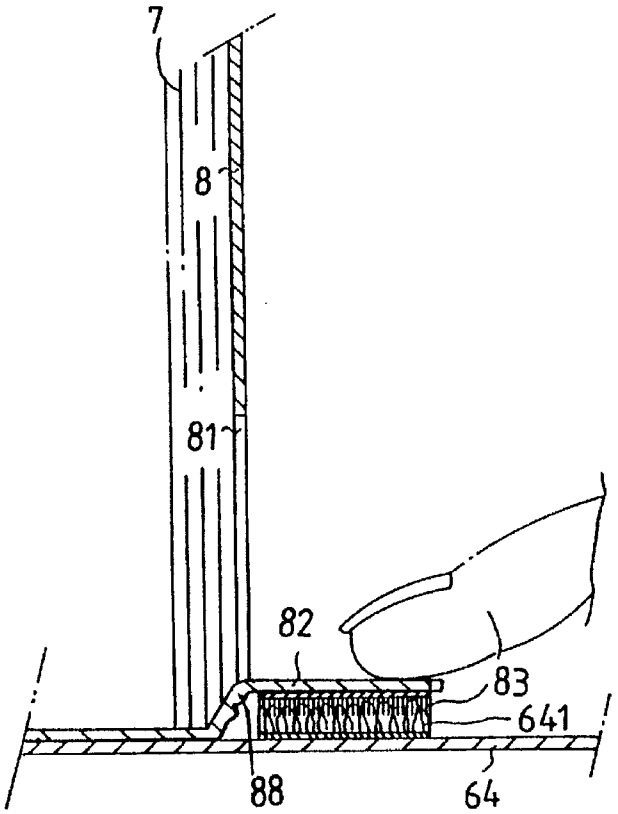
FIGS. 4, 5, 6, 7 and 8 are enlarged partial cross sectional views illustrating the operation of the file.
Figure 5:
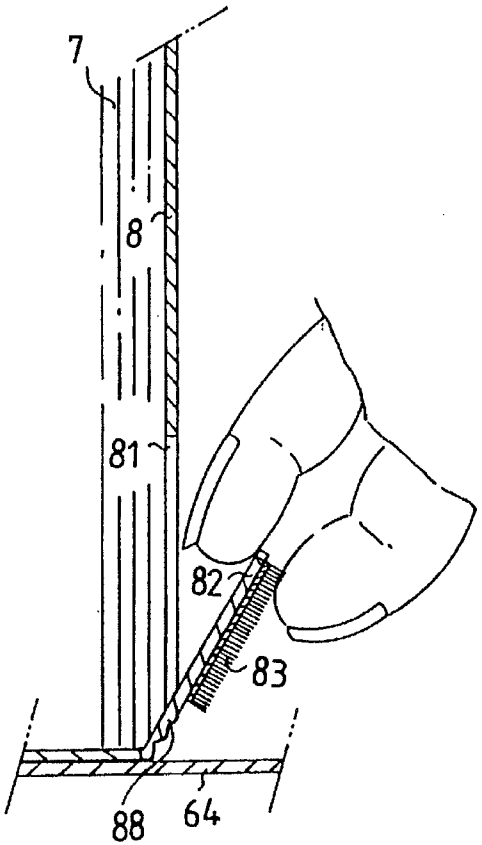
Figure 4:
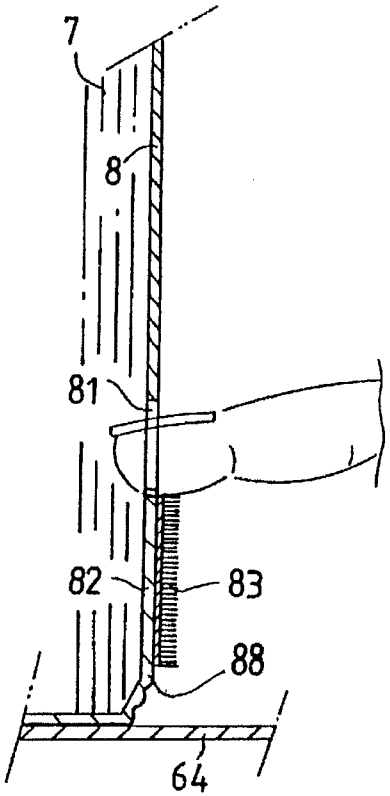
Figure 8:
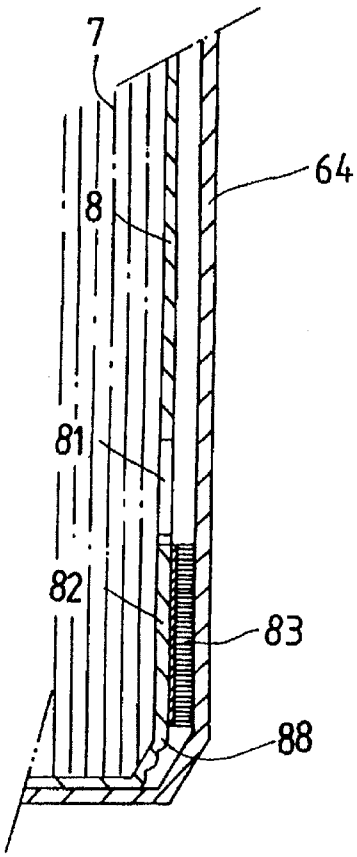
Figure 7:
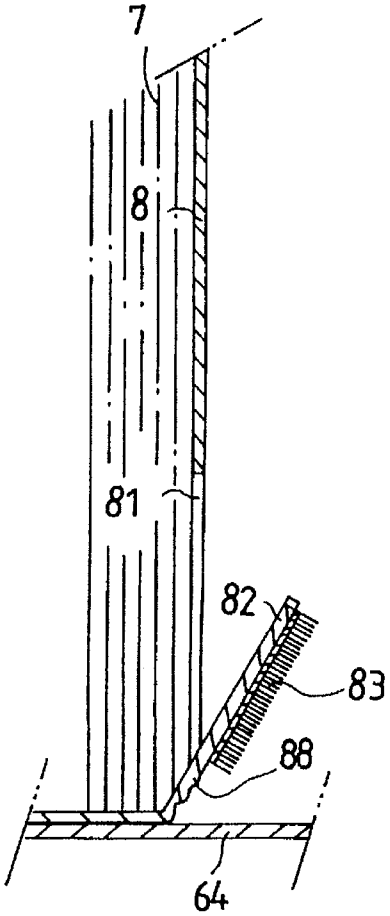

Referring next to FIGS. 4 to 9, and again to FIGS. 1 to 3, the plate 8 includes an opening 81 formed therein and includes an ear 82 having a bottom portion 88 secured to the plate 8 such that the ear 82 is foldable relative to the plate 8 about the bottom portion 88 thereof. The ear 82 is engaged in the opening 81 and has a size slightly smaller than that of the opening 81 such that a gap is formed above the ear 82 for engaging with the finger of a user. The ear 82 may be easily folded relative to the bottom portion 88 thereof (FIGS. 4 and 5) for pulling the plate 8 forward and away from the rear panel 6. The ear 82 includes a hook and loop type engaging member 83 secured thereon for engaging with the engaging member 641 of the front panel 64 when the front panel 64 is disposed horizontally (FIG. 6), such that the envelopes 7 may be maintained in the open position as shown in FIG. 3. When the engaging member 83 is disengaged from the engaging member 641, as shown in FIGS. 7 and 8, the ear 82 may spring back and spring upward to engage in the opening 81 of the plate 8 automatically.

It is to be noted that the front panel 64 may be stably supported in a horizontal position and need not be folded relative to the plate 8 such that the plate 8 may be moved away from the rear panel 6 horizontally without tilting the front panel 64, such that the documents received in the envelopes 7 will not be tilted and will not fall when moving the plate 8 away from the rear panel 6.

Accordingly, the accordion-like file in accordance with the present invention includes a number of envelopes that may be expanded without being tilted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An accordion-like file comprising:

a bottom panel, a rear panel secured to said bottom panel at a first folding line and foldable to a perpendicular position relative to said bottom panel, a front panel secured to said bottom panel at a second folding line and foldable to a perpendicular position relative to said bottom panel, said front panel including a first surface having a first engaging means provided thereon and including a second surface having a second engaging means provided thereon, a top panel secured to said rear panel at a third folding line and foldable to a perpendicular position relative to said rear panel, a cover panel secured to said top panel at a fourth folding line and foldable to a perpendicular position relative to said top panel, said cover panel including a third engaging means for engaging with said first engaging means so as to secure said cover panel to said front panel, a plurality of envelopes including a rear portion secured to said rear panel and including a front portion, and a plate secured to said front portion of said envelopes, said envelopes being expanded to an open position when said plate is moved away from said rear panel, said plate including an opening formed therein and including an ear engaged in said opening, said ear including a bottom portion secured to said plate so as to allow said ear to be folded relative to said plate about said bottom portion thereof, said ear including a fourth engaging means secured thereon for engaging with said second engaging means of said front panel when said front panel is disposed horizontally and when said envelopes are expanded so as to maintain said envelopes in the open position.

2. A file according to claim 1, wherein said ear is engaged in said opening and includes a size smaller than that of said opening so as to define a gap between said ear and said plate for engaging with a finger of a user.

* * * * *